United States Patent [19]

Malzacher

[11] Patent Number: 4,767,073

[45] Date of Patent: Aug. 30, 1988

[54] CABLE SPOOLING SYSTEM

[76] Inventor: Fred H. Malzacher, 5530 Rushmore St., Ventura, Calif. 93003

[21] Appl. No.: 833,510

[22] Filed: Feb. 20, 1986

Related U.S. Application Data

[60] Division of Ser. No. 649,274, Sep. 10, 1984, Pat. No. 4,588,142, which is a continuation-in-part of Ser. No. 284,691, Jul. 20, 1981, abandoned.

[51] Int. Cl.[4] ..... B65H 75/38

[52] U.S. Cl. ..... 242/54 R

[58] Field of Search ..... 242/54 R, 77, 85, 86.5 R, 242/86.8

[56] References Cited

U.S. PATENT DOCUMENTS

| | | | |
|---|---|---|---|
| 2,639,105 | 5/1953 | Farrar | 242/158 |
| 2,919,868 | 1/1960 | Frate | 242/158.3 |
| 3,429,374 | 2/1969 | Pridy | 166/65.1 |
| 4,155,518 | 5/1979 | Small | 242/86.5 R |

FOREIGN PATENT DOCUMENTS

| | | | |
|---|---|---|---|
| 2041317 | 9/1980 | United Kingdom | 242/158.3 |

OTHER PUBLICATIONS

Miloscia, Powered Cable Reel, Western Electric Technical Journal, No. 49, Jan. 1978.

*Primary Examiner*—David Werner
*Attorney, Agent, or Firm*—David O'Reilly

[57] ABSTRACT

A stationary or mobile cable spooling system for winding up electrical cables used on drilling rigs comprised of an axle for insertion into a cable spool, a yoke for rotationally mounting the axle, a hydraulic motor coupled to the axle for rotating the spool and a cable guide system which evenly winds the cable onto the spool. The cable guide system is comprised of a cable guide mounted on a diamond grooved shaft which traverses from one side of the shaft to the other guiding the cable onto the spool. The hydraulic motor is driven by a pressure compensated hydraulic pump which prevents excessive force being applied to the cable as it is being wound on a spool. If the cable should catch or bind in any fashion and the stress on the cable exceeds a certain amount, the hydraulic motor will slowly stop when the pressure in the hydraulic pump exceeds a pre-determined amount. The transportable spooling system is comprised of a tiltable frame having the spooling system mounted on a trailer for transporting the system by towing it from one site to another. The tilt frame is tilted up and locked for transportation and is tilted down to provide a stationary platform for use at a site.

24 Claims, 9 Drawing Sheets

CABLE SPOOLING SYSTEM

This is a divisional of co-pending application Ser. No. 649,274, filed on Sept. 10, 1984, now U.S. Pat. No. 4,588,142, which is a continuation-in-part of application Ser. No. 284,691, filed July 20, 1981, abandoned.

BACKGROUND

This invention relates to cable spooling systems and, more particularly, relates to an electrical cable spooling system.

Present systems for winding cable onto spools, particularly on off-shore drill rings, are permanently mounted to spools which are mechanically driven. One method is to apply an air motor with a wheel to the flange of the spool turning the spool to wind the cable on. A disadvantage of this method is that it requires two men to manually feed the cable onto the spool to get it at all even. This type of drive system is also particularly disadvantageous because excessive force can be applied to the cable even tearing the cable apart if the system is left unattended.

One system disclosed in prior art in U.S. Pat. No. 3,429,374, is described as portable but suffers from a number of drawbacks. Among these are the need for stabilizing pods or arms to stabilize the device when in use. These among other things increase the cost and the complexity of the system and limit portability. The stabilizing pods must be raised or lowered each time the spooling system is used. Another disadvantage is the use of a manually adjustable pressure relief valve which to limit the maximum pressure in a system. With this type of arrangement, the pressure is constant at the maximum pressure determined by the pressure relief valve. It does not compensate for the load on the system. An additional disadvantage is that this type of valve must be manually set or adjusted. With this type of system a constant tension is maintained on the cable being wound on the spool regardless of the load. Further, a tension sufficient to wind the cable on the spool may damage the cable if any resistance is met such as a binding or snag in the line.

An additional disadvantage is that auxiliary equipment is necessary to load and unload a spool. It would be advantageous if the system could be made self-loading.

SUMMARY

The purpose of the present invention is to provide a cable spooling system which evenly and automatically winds a cable onto a spool.

The present invention is comprised of a spool-winding system having a removable spindle or axle which can be inserted into a cable spool which is then mounted on a frame having latchable chucks. The spindle has a coupler for coupling to a hydraulic system for rotating the axle with the spool. The hydraulic system is a pressure-compensated hydraulic system which drives the spool through a hydraulic motor and a torque hub through a gear reduction to provide the proper torque on the axle for driving the cable spool. The pressure-compensated system slows down by itself and speeds up by itself to automatically eliminate excessive force on the cable if it should become bound up or caught in any way. If the cable becomes jammed when winding it up, the pressure-compensated pump will compensate for the increased load by gradually decreasing its output and will stop altogether, when the load exceeds a predetermined amount preventing any damage to the cable.

A pressure compensated pump provides greater protection than a simple pressure relief valve which provides constant pressure. This is because a pressure compensated pump is controlled by system pressure. As pressure increases, displacement of the pump decreases so that pump output at the preset pressure is only sufficient to make up the leakage. Thus if tension on the cable should increase causing an increase in the load on the pressure compensated pump its output will decrease so that the tension does not exceed the pre-determined value. Another advantage of this is that during periods when no flow is required in a hydraulic system the pump output is returned to the reservoir at low pressure. This increase pump life and system efficiency while reducing power consumption and heat.

The system also includes a guide means to automatically guide and wind the cable evenly on the spool. The guide system is mechanically connected to the spool drive system by sprockets and chains. The cable guide assembly is comprised of a cable guide through which the cable passes and is guided on to the spool. The cable guide is mounted on a diamond-grooved shaft to evenly and continuously traverses the shaft feeding the cable onto the spool back and forth in an even, smooth fashion. The cable guide assembly also includes a cable support and tensioner which keeps a light tension on the cable as it is being fed onto the spool. The cable tensioner is comprised of an idler wheel pivotally attached to the cable guide and biased by means of springs against the cable. The cable passes over the cable tensioner and under the cable guide and is fed onto the spool. The cable tensioning device keeps the cable engaged with the cable guide preventing slack from causing loops which might bind up as they pass through the cable guide. The cable guide and the cable tensioning device provided are of sufficient width or clearance to allow cable splices to easily pass through the cable guide means for uniform wrapping on the cable spool.

In an alternate embodiment of the invention the cable spooling system is mounted on a trailer chassis for transportability. In this embodiment, the spooling system is mounted on a tiltable frame secured to the trailer chassis above the trailer axle so that when tilted the entire weight of the spooling system and reel or drum is not supported by the axle.

The system is substantially the same as described before except that the combination chain drive has been eliminated. Separate drives for the spool axle are provided to permit varying the speed of the level wind system for different cables being wound on the spool. Further, it was found more advantageous particularly in the mobile spooling system with the tiltable frame and self-mounting spool to permit easy spool removal and remounting. Thus, a direct drive is provided for the spool axle and the level wind axle. To compensate for any difference in spool rotation and the level wind system the speed of the level wind system is adjustable.

The tiltable frame has a pair of rotatable lift arms or plates having sockets or yokes for receiving the axle supporting the spool. The axle is slipped through the spool and mounted in the lift arm split bearing yoke assemblies which are secured by a latch and pins. The lift arms are then hydraulically rotated from a horizontal to a vertical position by lift cylinders lifting the spool. This is accomplished with the tilt frame in the down position so that the combination of the tilt frame and the trailer chassis act as a stationary stabilizing platform during loading and unloading of reels.

As before, the drive system is comprised of a pressure compensated pump driving hydraulic motors and hydraulic cylinders through a multi-section control valve. The only difference between this arrangement and the previous embodiment is the use of a diesel engine for the pressure compensated hydraulic pump drive instead of a electrical drive for purposes of portability. Electric power may not always be available where the system is to be used.

The hydraulic drive system is comprised of a diesel engine driving a pressure compensated hydraulic pump and a control valve to operate the hydraulic cylinders and hydraulic motors. Two separate hydraulic lift cylinders control rotation of the spool lift arms to load and unload a spool. A third hydraulic cylinder is connected to operate the tilt frame pivotally mounted on the trailer chassis. Other sections of the control valve independently operate hydraulic motors for directly driving the level wind system and spool axle. The hydraulic drive circuit is mounted on a platform supported on the forward end of the trailer. A control console mounted on the forward end of the trailer chassis contains the controls for operating the various valves to control the hydraulic cylinders and the hydraulic motors and a remote control to adjust the pressure compensator of the hydraulic pump.

It is one object of the present invention to provide a cable spooling system which automatically evenly winds a cable on a spool.

Another object of the present invention is to provide a cable spooling device having a removable axle so that cable spool can be interchanged.

Another object of the present invention is to provide a cable spooling device in which the axle for mounting spools on which cable is wound, can be coupled or de-coupled to a hydraulic drive means.

Still another object of the present invention is to provide a cable spooling device having a pressure-compensated hydraulic drive system which automatically slows down by itself or speeds up by itself to eliminate excessive force on the cable being wound.

Still another object of the invention is to provide a cable spooling device having a cable guide assembly which provides evenly wound wraps of the cable on the spool.

Still another object of the present invention is to provide a cable spooling device having a cable tensioning idler wheel for maintaining tension on the cable during even winding on the cable spool.

Yet another object of the present invention is to provide a cable spooling device utilizing a diamond groove shaft to provide level, even winding of cable onto a spool.

Yet another object of the present invention is to provide a cable spooling device having sprockets and a chain drive system coupling the cable guide assembly to the drive system driving the axle rotating the cable spool.

Still another object of the present invention is to provide a cable spooling system having separate direct hydraulic drives for the axle rotating the cable spool and a level wind system.

Still another object of the present invention is to provide a automatic cable spooling system mounted on a trailer to provide a mobile spooling system.

Yet another object of the present invention is to provide a tilt frame attached to a trailer for providing a mobile cable spooling system.

Another object is to provide a mobile electronic cable spooling system having a spool self-loading system.

These and other objects will become apparent from the following detailed description of the invention when considered in conjunction with the accompanying drawings wherein like reference numbers identify like parts throughout.

DESCRIPTION OF THE PREFERRED EMBODIMENT

Figure 1:
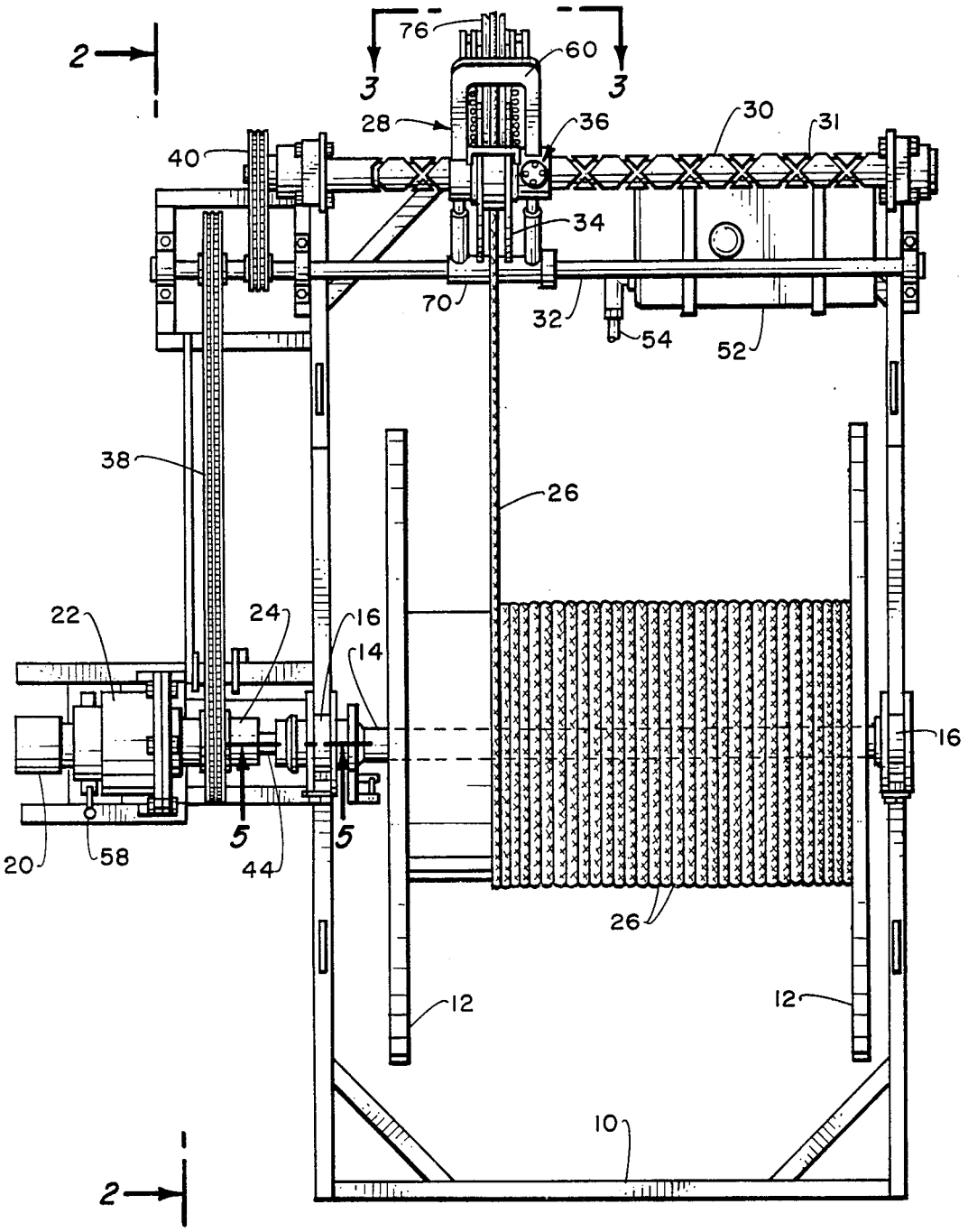
FIG. 1 is a top elevation of an electronic cable spooling system according to the present invention.

The cable spooling system of the present invention is shown generally in FIG. 1 and is comprised of a frame 10 on which is supported a cable spool 12 mounted on an axle 14. The axle 14 is removable from the frame 120 for changing spools 12. The axle 20 is mounted on vertical supports 86 (FIG. 2) having chucks which latch the axle to the frame 10 as will be described in greater detail hereinafter. The axle 14 and, consequently, the spool 12, are driven by means of a hydraulic motor 20 connected through a splined shaft to a torque hub 22 which drives a shaft 24 which can be coupled or de-coupled from the axle 14.

The cable 26 is guided onto the spool for even wrapping by means of a cable guide assembly 28 mounted for traversing the diamond groove shaft 30 as it is rotated. The cable guide assembly 28 is coupled to a tracking guide bar 32. The cable guide assembly 28 has a rotably free wheel 34 guiding the cable 26 on to the spool 12 which traverses the groove 31 of the diamond groove shaft 30 by means of a follower 46 mounted on the cable guide assembly 28. Thus, the cable guide assembly traverses the diamond groove shaft 30 from one side to the other, evenly distributing the cable 26 on the hub of the spool 12. When the cable gets to one end of the diamond groove shaft 3, it automatically reverses and continues to traverse in the other direction continuously feeding the cable onto the spool.

The cable guide assembly is connected to the same drive system which drives the axle 14 by means of chains 38 and 40 coupled to the diamond groove shaft 30 and the tracking guide bar 32 by means of sprockets.

Figure 2:
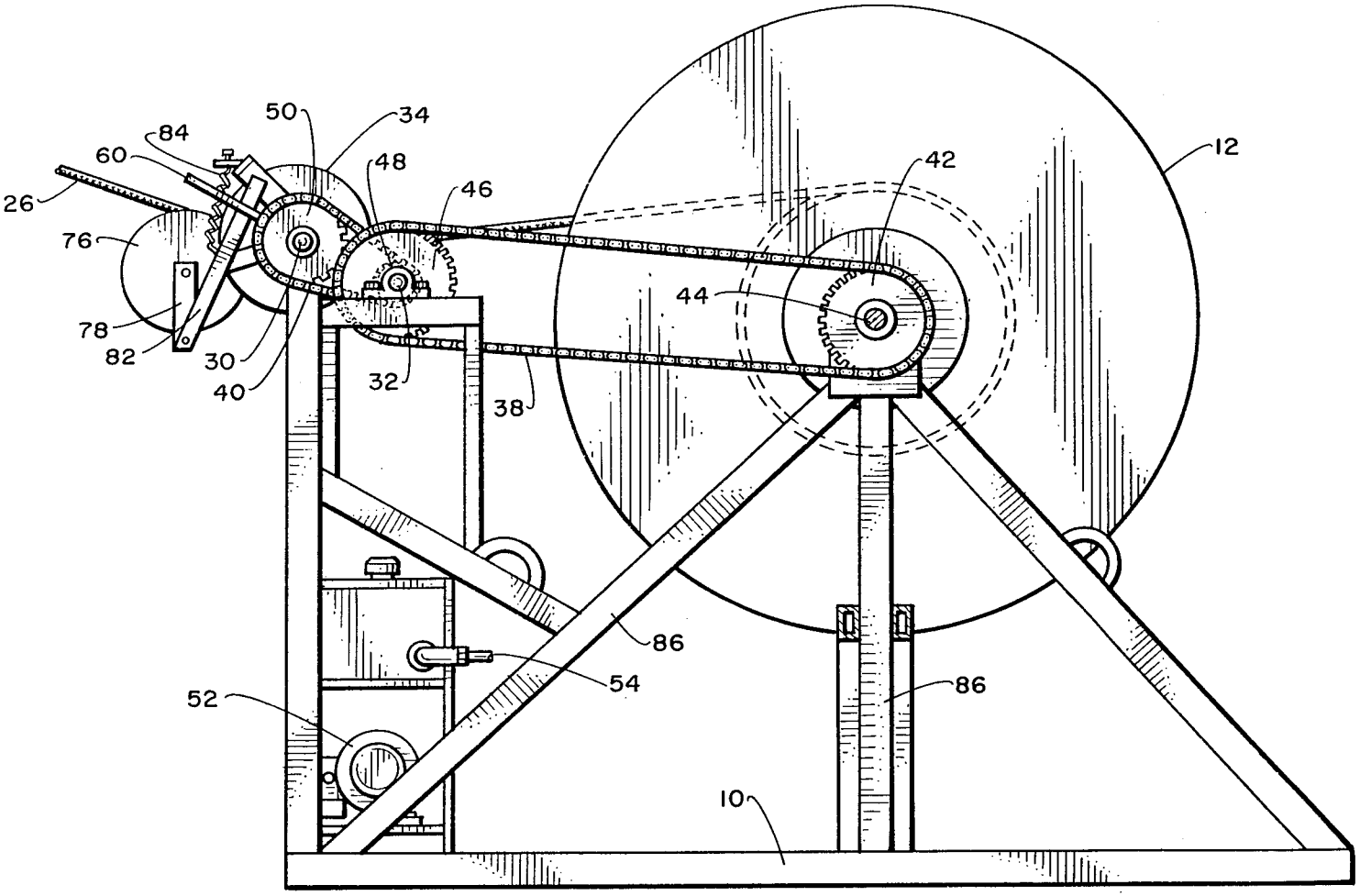
FIG. 2 is a side elevation of the cable spooling system taken at 2—2 of FIG. 1.
Figure 5:
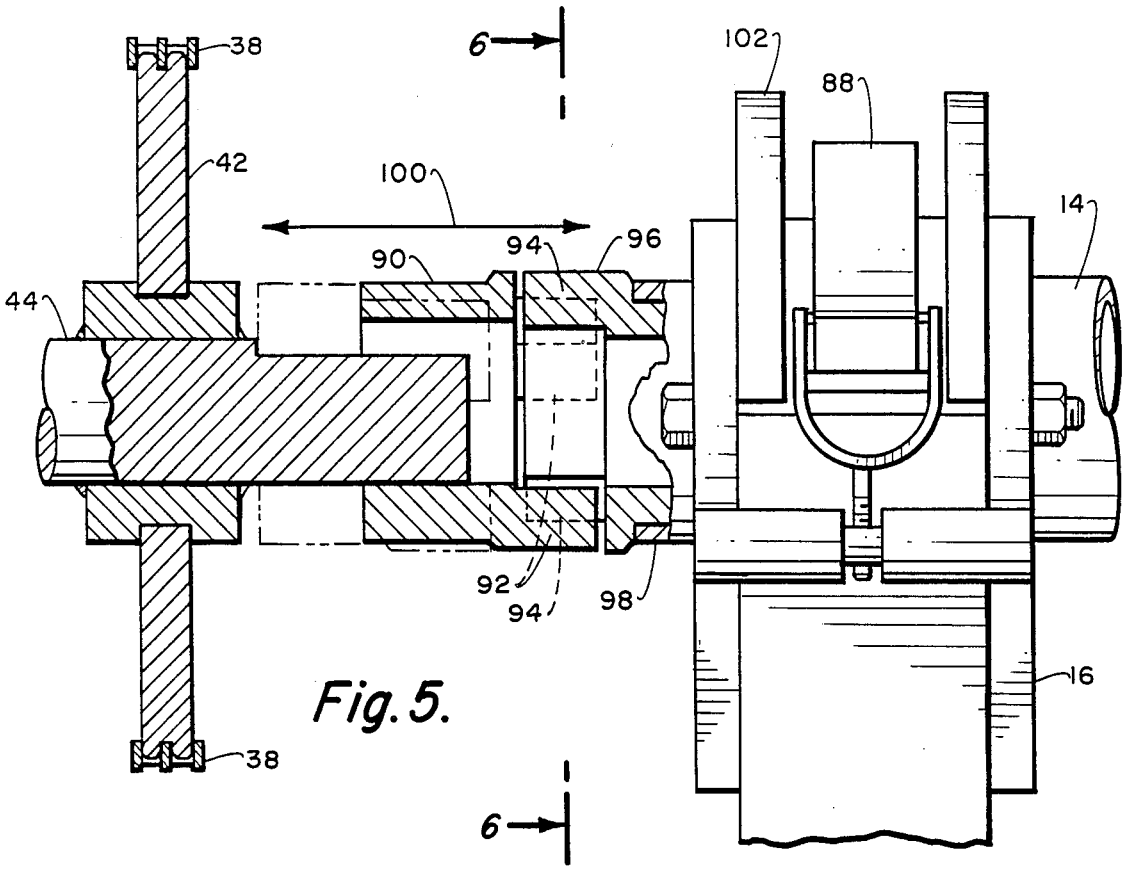
FIG. 5 is a detailed view in partial section illustrating the coupling of the axle to the hydraulic motor shaft.

The chain drive system and sprockets can best be seen in FIGS. 2 and 5. Sprocket 42 is mounted on drive shaft 44 driven by the torque hub 22 and hydraulic motor 20. Sprocket 46 is mounted on tracking guide bar 32. A second sprocket 48 mounted on the tracking bar 32 connects drive chain 40 to sprocket 50 mounted on the diamond groove shaft 30. Thus, the diamond groove shaft and tracking guide bar 32 are rotated simultaneously with the drive shaft 44 connected to the axle 14. Rotation of the tracking guide bar provides smooth even operation of the cable guide assembly 28 and promotes even wear.

The hydraulic drive system is a pressure-compensated system which will automatically slow down or speed up according to the tension or force needed to pull or wind the cable 26 on the spool 12. This system is comprised of a pressure-compensated hydraulic pump 52 connected by a hydraulic hose 54 through hydraulic valve 56 to hydraulic motor 20. The hydraulic valve 56 has an operating handle 58 which has a forward, center on and reverse position. Thus, the cable spooling system can be operated to wind up cable or to feed out cable, as desired.

Figure 3:
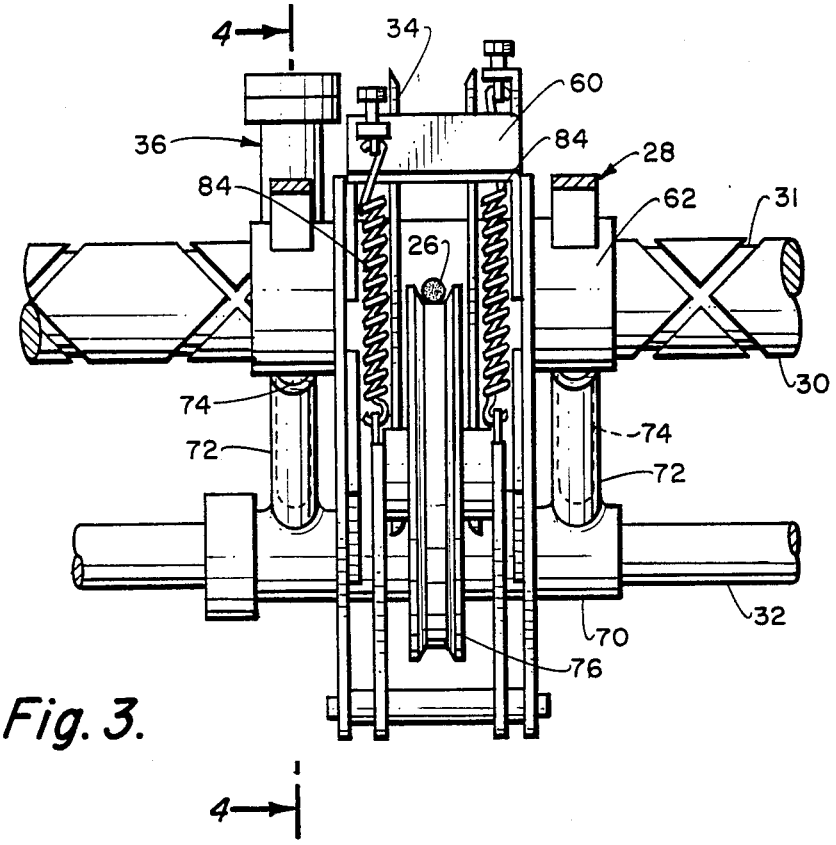
FIG. 3 is a partial sectional view taken at 3—3 of FIG. 1, illustrating the cable guide assembly.
Figure 4:
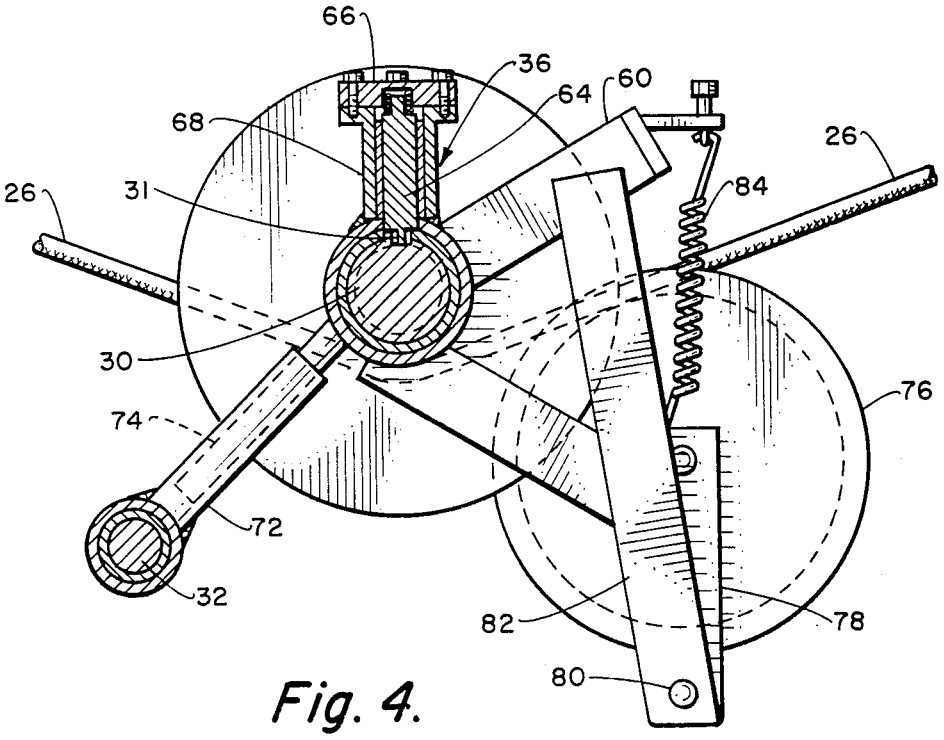
FIG. 4 is a sectional view taken at 4—4 of FIG. 3.

The cable guide assembly 28 is shown in greater detail in FIGS. 3 and 4. The assembly has a cable guide wheel 34 mounted for free-wheeling rotation on a frame 60 having a tubular portion 62 supported by bearings on the diamond groove shaft 30. The cable guide assembly tracks the groove in the diamond shaft by means of a diamond groove follower 36 having a spring biased pin 64 engaged in and following the groove 31 in the shaft. The cap 66 bolted on the follower permits a damaged or worn follower pin 64 to be changed or repaired, if necessary. The housing 68 for the diamond groove follower 36 is securely attached to the tubular portion 62 of the cable guide assembly by welding.

Tracking is also assisted by the tracking guide bar 32 connected to the cable guide assembly by means of a sleeve 70 having tubes 72 engaged by bars 74 securely attached to the tubular member 62 of the cable guide assembly. The connection by means of the tubes 72 and 74 prevents rotation of the cable guide assembly and assures rigidity and stability.

In order to maintain the cable 26 in contact with the slot or groove in the wheel 34, a tensioning device is provided. The tensioning device is comprised of an idler wheel 76 rotationally mounted on a bar 78 pivotally connected at 80 to a second bracket 82 secured to the frame 60 of the cable guide assembly. The idler wheel 76 is biased against cable 26 by means of springs 84. Thus, a constant tension is provided against the cable 26 preventing it from slipping out of the groove of cable guide wheel 34 should there by any slack.

Figure 6:
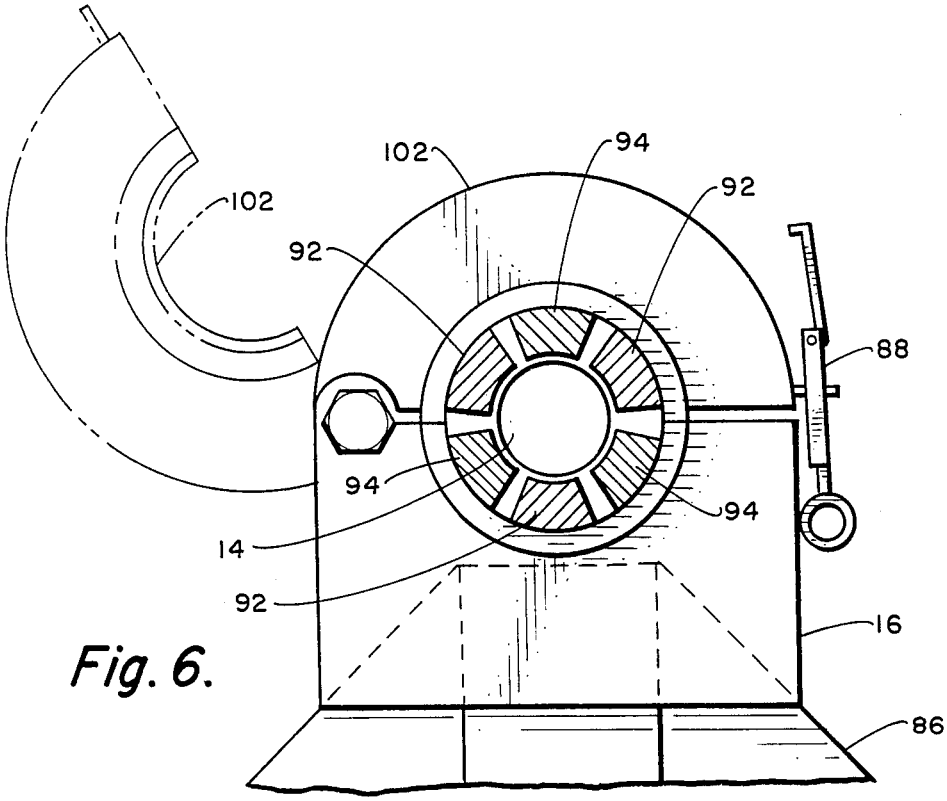
FIG. 6 is a sectional view taken at 6—6 of FIG. 5.
Figure 7:
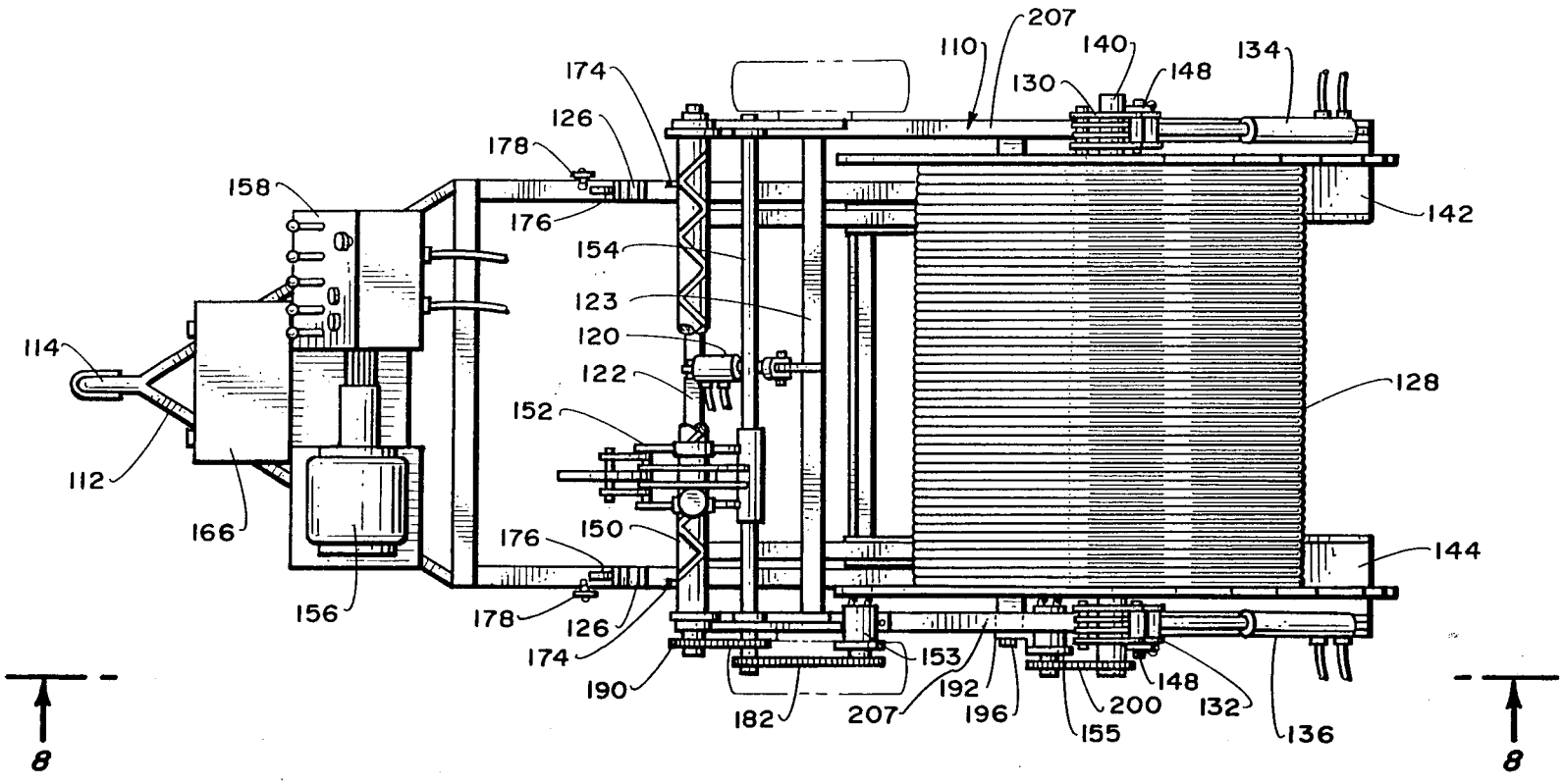
FIG. 7 is a top elevation of a mobile electronic cable spooling system according to the present invention.

The connection of the axle or spindle for mounting the cable spool 12 is illustrated in FIGS. 5 and 6. The axle 14 is positioned in a pair of split yokes lined with half-bushings 16 on either side of the frame supported by beams 86 illustrated in FIG. 2. The split yokes 16 are provided with latches 88 for opening and closing the split yokes to remove and replace the axle 14 for interchanging cable spools 12. The axle 14 is connected and disconnected from the drive shaft 44 by means of a jaw type split coupler 90 slidably mounted on the drive shaft 44 having teeth 92 meshing with teeth 94 on a coupler 96 attached to the end of the axle at 98. Thus, the coupler 90 can be slid on the drive shaft 44 as illustrated by the arrow 100 to couple or decouple the drive shaft from the axle.

To remove a full spool or change to a different size spool, the split yokes 16 are opened by releasing latches 88 allowing the hinged top portion 102 as shown in phantom in FIG. 6, to be opened. The spool with the axle 14 installed can then be lifted from the split yokes and stored. The axle is then removed from the spool and inserted in a new spool. The spool may now be easily lifted by its flanges with the axle inserted and placed in the split yokes mounted on the cable spooling device. The system shown is unique in that it provides a removable spindle allowing easy changing of spools.

Figure 8:
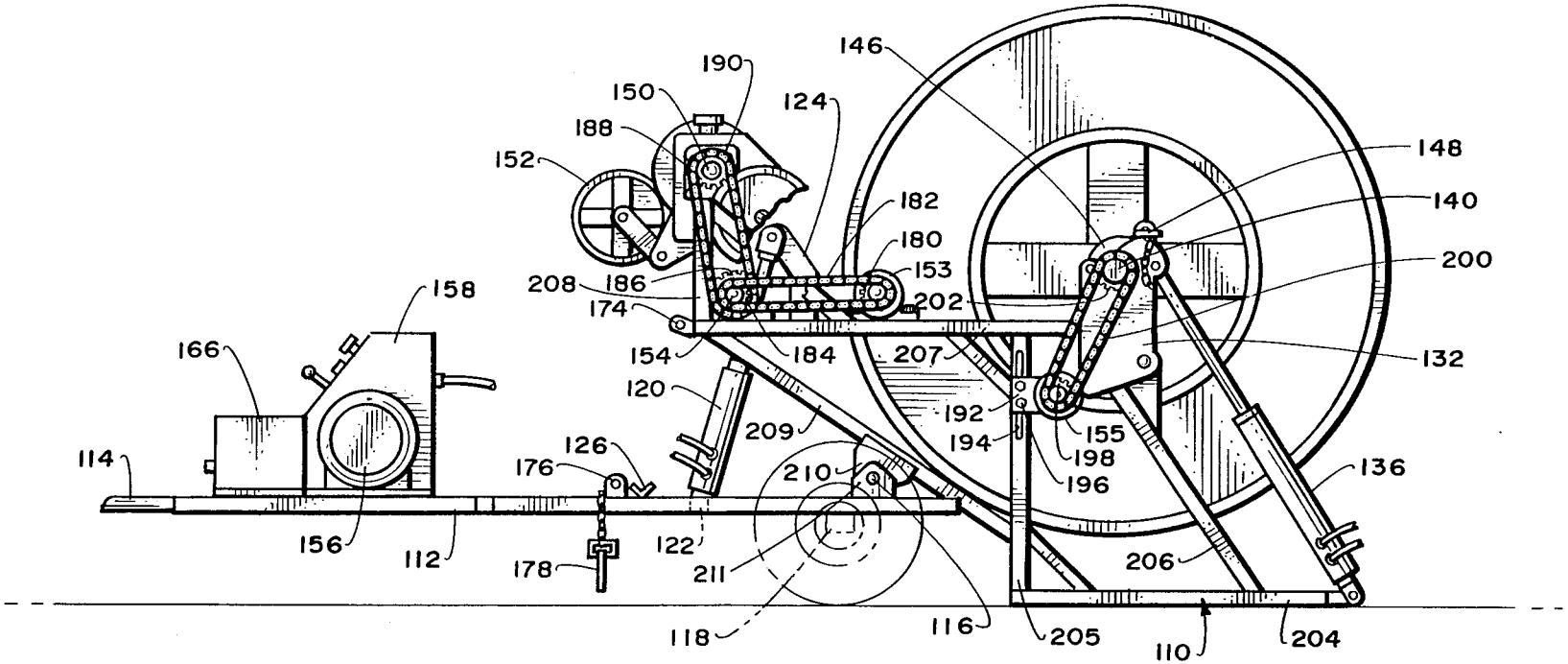
FIG. 8 is a side elevation of the mobile cable spooling system taken at 8—8 of FIG. 7, showing the loading of a spool.
Figure 9:
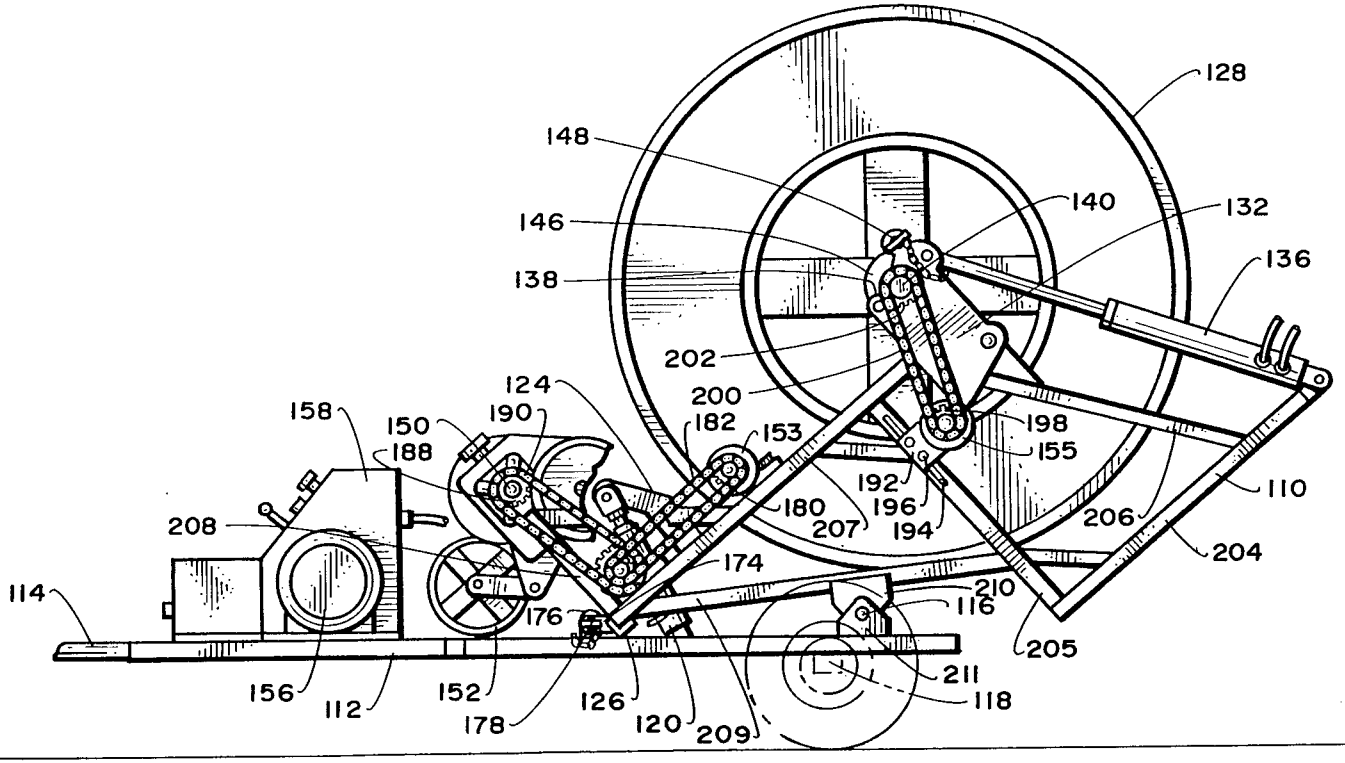
FIG. 9 is another side elevation of a mobile spooling system with the spool loaded for transporting.

The cable spooler system can also be made mobile for transporting to site to site as illustrated in FIG. 7 through 11. In this embodiment the spooling system is mounted on a tiltable frame 110 mounted on a trailer chassis 112 which has a trailer hitch 114 and wheels for transporting the cable spooler system to a site for use. The tilt frame 110 is shown more clearly in FIGS. 8 through 10. The tilt frame is constructed of beams and reinforcing support members pivotally mounted on brackets 116 on opposite sides of the trailer chassis close to the axle 118. The tilt frame is tilted from a stationary platform position to a position for transport by hydraulic cylinder 120 connected to cross member 122 on the trailer chassis and to arm 124 mounted on cross member 123. Angle brackets 126 on opposite sides of trailer chassis 112 support the tilt frame when tilted to the transport position as shown in FIG. 9.

The construction of tilt frame is illustrated in FIG. 8 and for each beam or support on one side there is a matching support beam on the opposite side. Beams 204, 205, 206, and 207 provide a trapezoidal structure which serves to support entirely a spool 128 mounted in the split yoke 132, relieving the trailer chassis and axle from all weight. With the tile frame tilted down the base 204 acts almost in the same manner as the stationary skid mounted support previously described. Beam 207 extends back to beam 208 which provides support for the level wind system. The entire tilt frame is supported by beam 209 and clevises 210 and 211 pivotally attached by pin 116.

Figure 10:
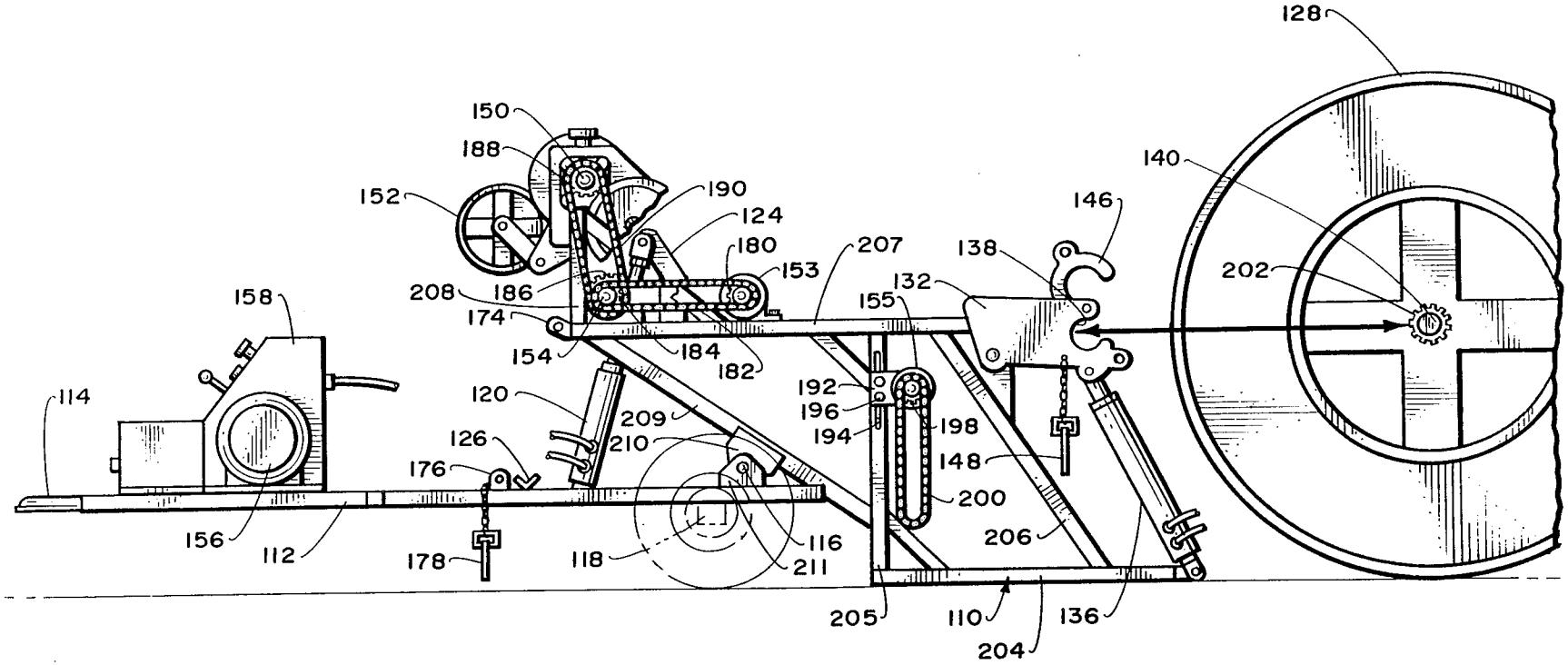
FIG. 10 is another side elevation of the mobile cable spooling system illustrating the spool self-loading system.

The drum or spool 128 is supported by rotatable lift arms or support plates 130 and 132 mounted on either side of the tilt frame 110 which are operated by hydraulic cylinders 134 and 136. The lift arms 130 and 132 each have split bearing yokes 138 for receiving a spindle or axle 140 supporting a spool. The length and size of lift arms are selected such that yokes 138, when lowered, are at a heighth approximately equal to that of axle 140 inserted in the spool as shown in FIG. 10.

To load a spool 128 axle 140 is first passed through the center of the spool. The spool is then rolled forward into pans 142 and 144 which help to guide the spool into yokes 138 in lift arms 130, 132 on the respective sides of tilt frame 110. The system shown, is self-loading. That is, no auxiliary or additional lifting equipment is required to load an unload a spool. Two men can easily load a empty or a full spool onto the mobile spooler. Once axle 140 is seated in yokes 138 in lift arms 130 and 132 the upper half 146 of the yokes are closed around and secured by pin 148 as shown in FIGS. 8 and 9. Thus spool 128 is securely latched to lift arms 130 and 132. Spool 128 can then be lifted by operation of hydraulic cylinders 134 and 136 to rotate lift arms 130, 132 to the position shown in FIG. 8. With tilt frame and loaded spool as shown the system is substantially a stationary platform spooling system with little or no weight on the trailer axle. In this position cable can be retrieved or paid out from the drum.

A particular advantage of this system is that no cranes, lift trucks or other lifting equipment is necessary for loading spools which can weigh up to 16 thousand pounds. Further once the spool or drum is loaded, the tilt frame 110 becomes a stationary platform with substantially no load being borne by the trailer axle. As in the stationary skid mounted platform system once a spool is loaded, and started, the system can spool cable without an operator. Once the pressure compensated hydraulic system is set for proper reel-up tension, an operator is free to perform other duties without the fear of stretching or tearing the cable, overheating the pump or causing any other damage should excess tension on the cable occur. As before the system is comprised of a level wind diamond bar 150, a cable tensioning system 152 and a guide bar 154.

Because of the self-loading spool design for lifting them by hydraulically operated lift arms the combination chain drive of the stationary skid mounted platform is not used. A direct drive is preferred to allow for differences which might occur in rotational speed of the cable spool 128 and the level wind system. With a direct drive the level wind speed can be varied according to cable size and spool rotational speed.

The direct drive is provided for the diamond bar 150 and the spool axle 140 by hydraulic motors 153 and 155 connected through gears and chain drives as shown in FIG. 10.

The hydraulic motor 155 is adjustably mounted on beam 205 by plate 192 and bolts 196 riding in slot 194. The hydraulic motor 155 drives the spool 128 through chain 200 connecting sprockets 198 and 202. Sprocket 202 is mounted permanently on the end of axle 140. The ajustable mounting of the hydraulic drive motor 155 permits loosening of the chain 22 to remove it from the sprocket 202 when loading and unloading a spool 128. After a spool is loaded the chain 22 is placed around sprocket 202 and the hydraulic drive motor 155 adjusted to tighten the chain.

The level wind system and guide bar are rotated by hydraulic drive motor 153 connected to the guide bar 154 by chain 182 mounted on sprockets 180 and 184. The guide bar 152 is in turn geared to the diamond bar 150 by chain 190 mounted on sprockets 186 and 188. The hydraulic drive motor 153 may be fixed or adjustably mounted on beam 207 if desired. Each of the hydraulic drive motors 153 and 155 are independently connected to controls as shown in the schematic diagram of FIG. 11 which will be described in greater detail hereinafter.

Figure 11:
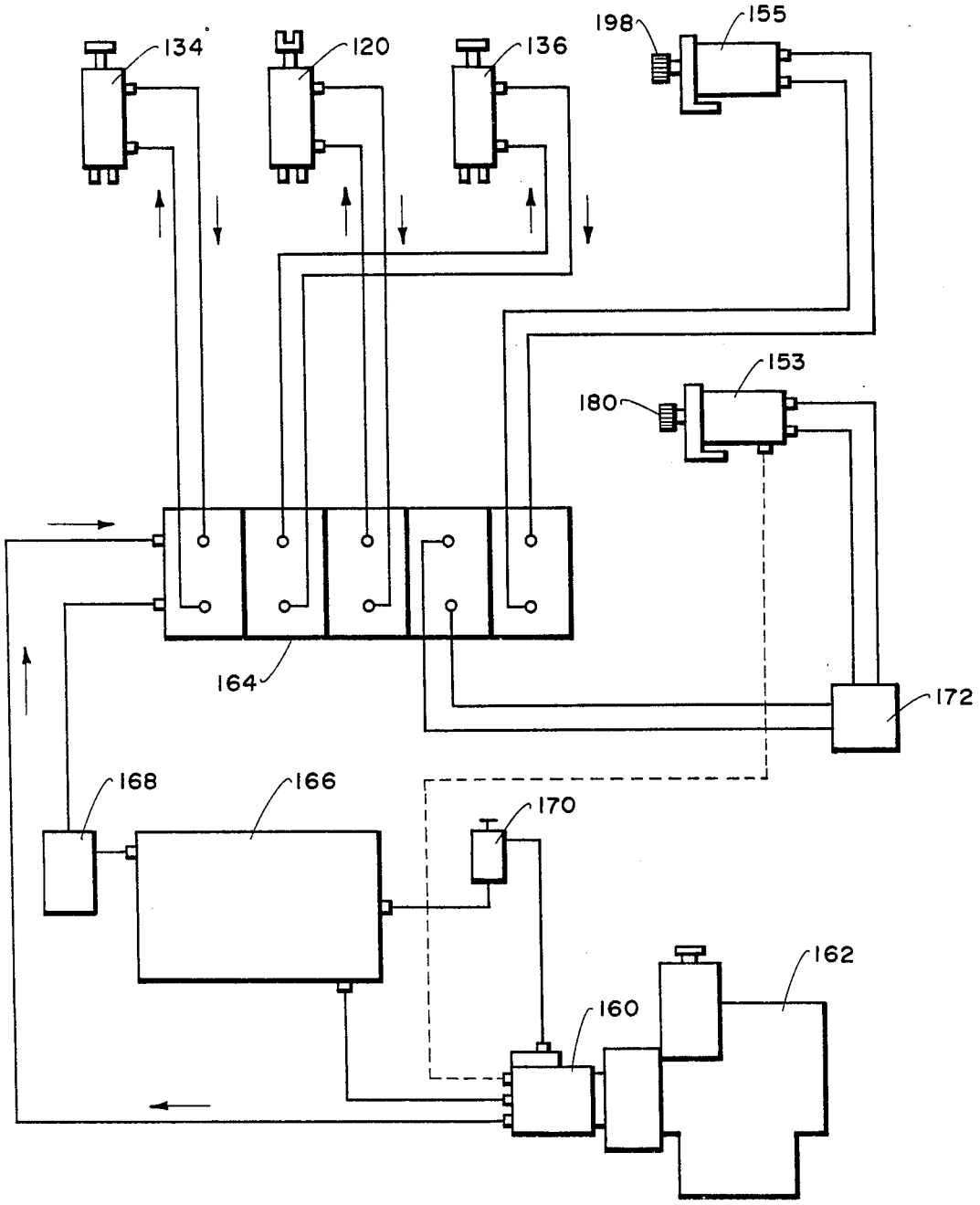
FIG. 11 is a schematic diagram illustrating the operation of the hydraulic drive system of the mobile cable spooler.

The hydraulic drive system is mounted on the forward end of the trailer chassis and is comprised of a diesel powered pressure compensated pump 156, reservoir 166, and a control console 158 shown in greater detail in the schematic diagram of FIG. 11.

In FIG. 11 pressure compensated pump 160 is driven by diesel engine 162. Diesel engine 162 is preferred because its portability rather than an electric drive because electrical power may not always be available where a mobile spooling system would be used. The diesel driven pressure compensated system provides hydraulic pressure through a five spool control valve 164 to hydraulic motors 153 and 155, hydraulic cylinder 120 for tilting the tilt frame and hydraulic cylinders 134 and 136 for operating lift arms 132, 134 to lift a spool 178. Independently operated hydraulic cylinders 134 and 136 are on either side for lifting the spool because it may require a little more force to lift the spool on one side than the other because of an uneven load on the drum. The hydraulic cylinders 134 and 136 are attached at one end to the end of beam 204 and are pivotally attached to lift arms 134, 134 at the other end. Hydraulic fluid is returned through the control system to a reservoir 166 through a filter 168.

Since the level wind system is not directly coupled to the spool drive system, level wind hydraulic motor 153 is provided withy a variable speed control to increase or decrease the speed as desired. Additionally, valve 170 is mounted on the console and provides for remote adjustment of the pressure compensated pump.

The following components are given by way of example for use in the hydraulic drive circuit of the invention. The hydraulic pressure compensated pump 156 may be a Vickers Model PV 810 with a remotely adjustable pressure compensator. A remotely adjustable pressure compensator allows adjustment of the pressure by valve 170 at a control console. Control valve 164 may be a Gresen Model V20 five spool or section valve having forward and reverse positions with a center or neutral off, position. This permits hydraulic motors 153 and 155 to be operated in forward or reverse direction. Alternatively, the two hydraulic motors could be operated from the same valve with a speed control 172 provided to vary the speed of the level wind hydraulic motor 152 if desired. The hydraulic motors are preferrably a Char Lynn Model 104, or the like.

The mobile spooling system is operated by transporting the system to a location for use. The system may be transported with or without an empty spool. During transport tilt frame is anchored by clevis 174 secured to clevis 176 on opposite sides of the trailer chassis by pin 178. This secures the tilt frame in a transport position. Once at a site, the trailer is parked pins 178 are removed and frame 110 tilted down until beams 204 and guide pans 142 and 144 are fully supported by a flat surface such as the ground. Spool lift arms 130 and 132 are then rotated to a horizontal position after removing the chain 200 from sprocket 202 as shown in FIG. 10 to load an empty spool if not already loaded. A spool is loaded by inserting an axle having sprocket 202 into the spool and rolling the spool onto pans 142, 144 until the ends of the axle seat in yokes 138 as shown in FIG. 10. Latches or upper half of the yoke 146 are closed and pinned as shown in FIG. 9. Chain 200 is then mounted on sprocket 202. Lifting arm cylinders 134 and 136 are then operated to rotate lift arms 130 and 132 to a vertical position lifting the spool. The system is now ready for use.

To reel up an electronic cable it is passed through idler tensioning system 152 and a few wraps are started on spool 128. This is accomplished with the diesel engine started and the control valve in the center or neutral position. The control valve is then switched to the reel up position with the pressure compensators set for proper reel up tension to insure that no tension which will stretch or tear the cable is applied and hydraulic drive motor 153 is adjusted for the proper speed. Once operation is begun the operator is free to perform other duties as cable will be continuously and evenly wound on the spool. Once the reeling up operation is completed or the spool is full the procedure can be repeated with a new spool by simply reversing the operation. That is the control valve is switched to a neutral position to stop spool rotation and lifting arms are lowered setting the drum on the ground. A fully loaded drum now may be easily disengaged from the lifting arm yokes 138. Chain 200 is removed from sprocket 202 and axle or spindle 140 may then be removed from the full spool and inserted into another empty spool to begin operation again.

Thus, there has been disclosed a unique cable spooling system providing automatic winding of a cable on interchangeable spools. The system has unique cable guide assembly and a hydraulic drive system which automatically compensates for tension on the cable and will even stop if tension gets excessive, preventing cable damage. Thus, the system disclosed and described can be started and will automatically wind cable on the spool without any attendance.

Obviously, many modifications and variations of the invention are possible in the light of the above teachings. It is therefore to be understood that the full scope of the invention is not limited to the details disclosed therein, but only by the claim appended hereto and may be practiced otherwise than as described.

What is claimed is:

1. An electronic cable spooling system for spooling fragile electronic cables comprising;
- frame means;
- axle means for mounting a cable spool;
- support means on said frame means for rotatably supporting said axle with said cable spool;
- drive means for rotatably driving said axle and cable spool, said drive means comprising;
  - pressure compensated hydraulic pump means;
  - a hydraulic motor;
  - hydraulic valve means connecting said pressure compensated hydraulic pump means to said hydraulic motor;
  - said pressure compensated hydraulic pump means having preselected self-compensation of the rotational torque applied to said axle and cable spool;
- cable guide means guiding an electronic cable onto said cable spool for storage;
- whereby said drive means is carefully controlled to maintain a torque on an electronic cable substantially below a level which would cause damage; said drive means stalling when the torque required to wind said cable exceeds the preselected self-compensation of the rotational torque of said pressure compensating pump.

2. The cable spooling system according to claim 1 in which said axle mounting means comprises;
- a pair of hinge yokes on opposite sides of said frame means;
- axle bearing means on each of said yokes;
- yoke latch means on each of said yokes constructed to open for removal of said axle;
- whereby said axle may be inserted into a cable spool and then mounted in said yokes and latched to secure said axle and cable spool.

3. The cable spooling system according to claim 2 in which said drive means includes selective engagement means for engaging or disengaging said hydraulic motor from said axle.

4. The cable spooling system according to claim 3, wherein said selective engagement means comprises;
- coupling means attached to the end of said axle;
- slidable coupling engagement means attached to the end of a torque hub shaft driven by said hydraulic motor means whereby said axle may be selectively engaged or disengaged from said hydraulic motor means.

5. The cable spooling system according to claim 4 wherein said cable guide means is comprised of;
- diamond groove shaft means;
- cable guide assembly means slidably mounted on said diamond groove shaft means;
- follower means secured to said cable guide assembly means and engaging the groove of said diamond groove shaft;
- drive means for rotationally driving said diamond groove shaft whereby said cable guide assembly means traverses said diamond groove shaft from one end to the other and back.

6. The cable spooling system according to claim 5 including;
- a tracking guide bar parallel to and spaced from said diamond groove shaft;
- connecting means connecting said tracking guide bar to said cable guide assembly means for tracking the movement of said cable guide assembly means on said diamond shaft.

7. The cable spooling system according to claim 6 wherein said connecting means comprises;
- a sliding sleeve mounted on said tracking guide bar;
- variable length coupling means coupling said sleeve to said cable guide assembly means whereby said variable length coupling means provides stability and prevents rotation of said cable guide assembly means.

8. The cable spooling system according to claim 7 wherein said drive means for said diamond groove shaft means comprises;
- drive connecting means connecting said diamond groove shaft to said hydraulic motor means whereby said diamond groove shaft is rotated simultaneously with said axle and cable spool.

9. The cable spooling system according to claim 8 wherein said drive connecting means comprises;
- a sprocket on said torque hub shaft;
- a sprocket on the end of said diamond groove shaft means; and
- drive chain assembly means connecting the sprocket on said torque hub shaft to the sprocket on said diamond groove shaft means.

10. The cable spooling system according to claim 9 wherein said drive chain assembly means includes;
- sprocket means on said tracking guide bar; and
- a drive chain connecting said sprocket means to said torque hub shaft driven by said hydraulic motor means for rotating said tracking guide bar.

11. The cable spooling system according to claim 10 wherein said hydraulic motor means is comprised of;
- a hydraulic pump;
- a hydraulic motor;
- hydraulic valve means connecting said hydraulic pump to said hydraulic motor;
- a torque hub connecting said hydraulic motor to a shaft for simultaneously driving said axle and said chain drive assembly means;
- said hydraulic pump comprising a pressure compensated hydraulic pump whereby said spooling device provides self-compensation of the rotational torque on said cable spool.

12. The cable spooling system according to claim 11 wherein said hydraulic valve means includes means for reversing said hydraulic motor.

13. The cable spooling device according to claim 5 wherein said cable guide assembly includes cable tensioning means for providing a constant tension on said cable as it is fed through said cable guide assembly means.

14. The cable spooling system according to claim 13 wherein said cable tensioning means comprises;

an idler wheel adjacent to cable guide means;

biasing means applying a biasing force on said idler wheel whereby said cable passes over said idler wheel to said cable guide assembly means at a substantially constant tension.

15. The cable spooling system according to claim 1 wherein said axle drive means comprises a hydraulic motor means and selective engagement means for engaging or disengaging said hydraulic motor from said axle.

16. The cable spooling system according to claim 13 wherein said selective engagement means comprises;

coupling means attached to the end of said axle;

slidable coupling engagement means attached to the end of the hydraulic motor shaft whereby said axle may be selectively engaged or disengaged from said hydraulic motor means.

17. The cable spooling system according to claim 1 wherein said cable guide means comprise;

a diamond groove shaft means;

cable guide assembly means slidably mounted on said diamond groove shaft;

follower means secured to said cable guide assembly means and engaging the groove of said diamond groove shaft;

drive means for rotatably driving said diamond groove shaft whereby said cable guide means traverses said diamond groove shaft from one end to the other and back.

18. The cable spooling system according to claim 17 including;

a tracking guide bar parallel to and spaced from said diamond groove shaft;

connecting means connecting said tracking guide bar to said cable guide means for tracking the movement and preventing rotation of said cable guide assembly means on said diamond shaft.

19. The cable spooling system according to claim 18 wherein said connecting means comprises;

a sliding sleeve mounted on said tracking guide bar;

variable length coupling means coupling said sleeve to said cable guide assembly means whereby said variable length coupling means provides stability and prevents rotation of said cable guide assembly means.

20. The cable spooling system according to claim 19 wherein said drive means for said diamond groove shaft means comprises;

drive connecting means connecting said diamond groove shaft to said hydraulic motor means whereby said diamond groove shaft is rotated simultaneously with said axle and cable spool.

21. The cable spooling system according to claim 20 wherein said drive connecting means comprises;

a sprocket on the shaft of said hydraulic motor means;

a sprocket on the end of said diamond groove shaft means; and drive chain assembly means connecting the sprocket on shaft of said the hydraulic motor means to the sprocket on the diamond shaft means.

22. The cable spooling system according to claim 21 wherein said drive chain means includes;

sprocket means on said tracking guide bar; and a drive chain connecting said sprocket means to said hydraulic motor means for rotating said tracking guide bar.

23. The cable spooling system according to claim 22 wherein said hydraulic motor means comprises;

a hydraulic pump;

a hydraulic motor;

hydraulic valve means connecting said hydraulic pump to said hydraulic motor;

a torque hub connecting said hydraulic motor to a shaft for simultaneously driving said axle and said chain drive assembly means;

said hydraulic pump comprising a pressure compensated hydraulic pump whereby said spooling device provides self-compensation of the rotational torque on said cable spool.

24. The cable spooling system according to claim 23 wherein said cable guide assembly means includes cable tensioning means for providing a consistent tension on said cable as it is fed through said cable guide means.

* * * * *